US008714847B2

(12) United States Patent
Tsuji

(10) Patent No.: US 8,714,847 B2
(45) Date of Patent: May 6, 2014

(54) TAPE PRINTER AND TAPE PRINTER CONTROL METHOD

(75) Inventor: Akinori Tsuji, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 431 days.

(21) Appl. No.: 12/820,367

(22) Filed: Jun. 22, 2010

(65) Prior Publication Data

US 2011/0002725 A1 Jan. 6, 2011

(30) Foreign Application Priority Data

Jul. 2, 2009 (JP) ..... 2009-157541

(51) Int. Cl.
*B41J 5/30* (2006.01)

(52) U.S. Cl.
USPC ..... 400/62; 400/65; 400/88; 400/611

(58) Field of Classification Search
CPC ..... G03G 15/6573; G03G 2215/00421; G03G 2215/00426; G03G 2215/00535; G03G 2215/00827; G03G 2215/00822; G03G 2215/00856; G03G 2215/00848; G03G 2215/00924; G03G 2215/00928
USPC ..... 400/62, 88, 613, 65, 78, 583, 611
See application file for complete search history.

(56) References Cited

U.S. PATENT DOCUMENTS

| | | | | |
|---|---|---|---|---|
| 4,623,418 | A * | 11/1986 | Gombrich et al. | 156/361 |
| 5,496,117 | A * | 3/1996 | Sawada et al. | 400/61 |
| 2008/0205959 | A1 * | 8/2008 | Miyashita et al. | 400/76 |

FOREIGN PATENT DOCUMENTS

| | | | |
|---|---|---|---|
| JP | 5-185695 | A | 7/1993 |
| JP | 7-007943 | U | 2/1995 |
| JP | 7-276746 | A | 10/1995 |
| JP | 2005-138556 | A | 6/2005 |

* cited by examiner

*Primary Examiner* — Matthew G Marini
(74) *Attorney, Agent, or Firm* — ALG Intellectual Property, LLC

(57) ABSTRACT

A tape printer which prints an inputted character string on a tape includes: an input unit receiving input of the character string; a detecting unit detecting a keyword which contains a first character string expressing a number from the character string received by the input unit; and a printing unit performing sequential number printing which repeats printing while sequentially changing the first character string when the detecting unit detects the keyword.

7 Claims, 11 Drawing Sheets

TAPE PRINTER AND TAPE PRINTER CONTROL METHOD

The entire disclosure of Japanese Patent Application No. 2009-157541, filed on Jul. 2, 2009, is expressly incorporated by reference herein.

BACKGROUND

1. Technical Field

The present invention relates to a tape printer and a tape printer control method for printing an inputted character string on a tape.

2. Related Art

In the field of a tape printer which prints an inputted character string or the like on a tape (label), such a type of tape printer which has a function of printing an inputted character string such as numerals and alphabets on a tape while sequentially changing the characters (sequential number printing function) is known (for example, see JP-UM-A-7-7943). According to this type of tape printer, the character string need not be repeatedly inputted even when plural labels containing variable numerals and alphabets are produced. Thus, the usability of the tape printer for users improves.

However, for using the sequential number printing function, particular operation needs to be performed. Thus, such users who do not read the operation manual before using the tape printer and thus have no knowledge for carrying out the sequential number printing function or have no knowledge of the operation method of this function for other reasons cannot use the sequential number function. Moreover, there are many users who are unfamiliar with the tape printer and thus do not even know that the tape printer has the sequential number printing function. Under these circumstances, this convenient function of sequential number printing is not a function fully utilized by users.

SUMMARY

It is an advantage of some aspect of the invention to provide a technology capable of solving at least a part of the problems described above, and the invention can be embodied as the following forms or aspects.

A first aspect of the invention is directed to a tape printer which prints an inputted character string on a tape, and includes: an input unit receiving input of the character string; a detecting unit detecting a keyword which contains a first character string expressing a number from the character string received by the input unit; and a printing unit performing sequential number printing which repeats printing while sequentially changing the first character string when the detecting unit detects the keyword.

According to this aspect of the invention, the tape printer performs sequential number printing when the keyword containing the first character string expressing a number is detected in the character string received by the input unit. Thus, such a user unfamiliar with the operation of the tape printer can easily carry out sequential number printing.

A second aspect of the invention is directed to the tape printer of the above aspect, wherein the keyword detected by the detecting unit includes the first character string, and a second character string indicating that the first character string expresses a number.

According to this aspect of the invention, the tape printer performs sequential number printing when the character string received by the input unit contains both the first character string expressing a number and the second character string indicating that the first character string expresses a number. Thus, sequential number printing can be further securely performed (unnecessary sequential number printing is not performed).

A third aspect of the invention is directed to the tape printer of the above aspect which further includes a control unit which asks whether sequential number printing is performed or not and receives an answer to this inquiry when the detecting unit detects the keyword. In this case, the printing unit performs the sequential number printing when the control unit receives an answer which shows that the sequential number printing is performed.

According to this aspect of the invention, the control unit of the tape printer asks the user whether sequential number printing is performed or not when the keyword containing the first character string expressing a number is detected in the character string received by the input unit. When the control unit receives an answer which shows that sequential number printing is performed, the printing unit performs sequential number printing. Thus, unnecessary sequential number printing is not carried out.

A fourth aspect of the invention is directed to the tape printer of the above aspect which further includes a control unit which requires the number of sheets for the sequential number printing to be specified when the detecting unit detects the keyword. In this case, the printing unit repeats printing for the number of times corresponding to the specified number of sheets for the sequential number printing while sequentially changing the first character string.

According to this aspect of the invention, the tape printer repeats printing for the number of times corresponding to the specified number of sheets for printing. Thus, the necessity for repeating the printing operation is eliminated, and the usability of the tape printer is enhanced.

A fifth aspect of the invention is directed to the tape printer of the above aspect which further includes a control unit which requires a third character string expressing a number to be inputted when the detecting unit detects the keyword. In this case, the printing unit repeats printing while sequentially changing the first character string until the first character string agrees with the inputted third character string.

According to this aspect of the invention, the tape printer having received the input of the third character string expressing a number repeats printing from the first character string until the third character string. Thus, the necessity for repeating the printing operation is eliminated, and the usability of the tape printer is enhanced.

A sixth aspect of the invention is directed to a control method of a tape printer which prints an inputted character string on a tape, and the control method includes: receiving input of the character string; detecting a keyword which contains a character string expressing a number from the received character string; and performing sequential number printing which repeats printing while sequentially changing the character string when the keyword is detected.

According to this aspect of the invention, the tape printer control method performs sequential number printing when the keyword containing the character string expressing a number is detected in the inputted character string. Thus, such a user unfamiliar with the operation of the tape printer can easily execute sequential number printing.

The above aspects of the invention can be practiced in the form of a recording medium or the like having stored a program produced according to the above aspects in such a manner as to be readable by a computer. The recording medium may be various types of recording medium readable by the computer such as a flexible disk, a hard disk, an optical disk like CD and DVD, a photo-electromagnetic disk, a memory card and a USB memory containing non-volatile semiconductor memory, and an internal memory device of an image forming apparatus (semiconductor memory such as RAM and ROM).

BRIEF DESCRIPTION OF THE DRAWINGS

The invention will be described with reference to the accompanying drawings, wherein like numbers reference like elements.

DESCRIPTION OF EXEMPLARY EMBODIMENTS

A tape printer which prints an inputted character string or the like on a tape is hereinafter described with reference to the drawings.

Figure 1:
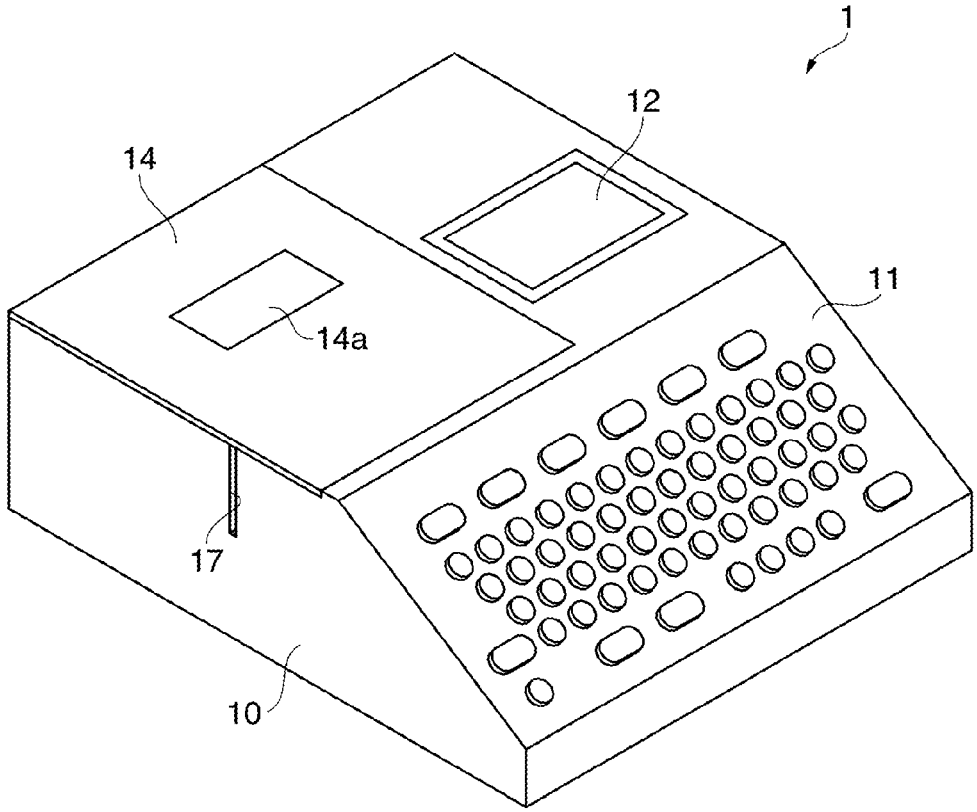
FIG. 1 is a perspective view of a tape printer.
Figure 2:
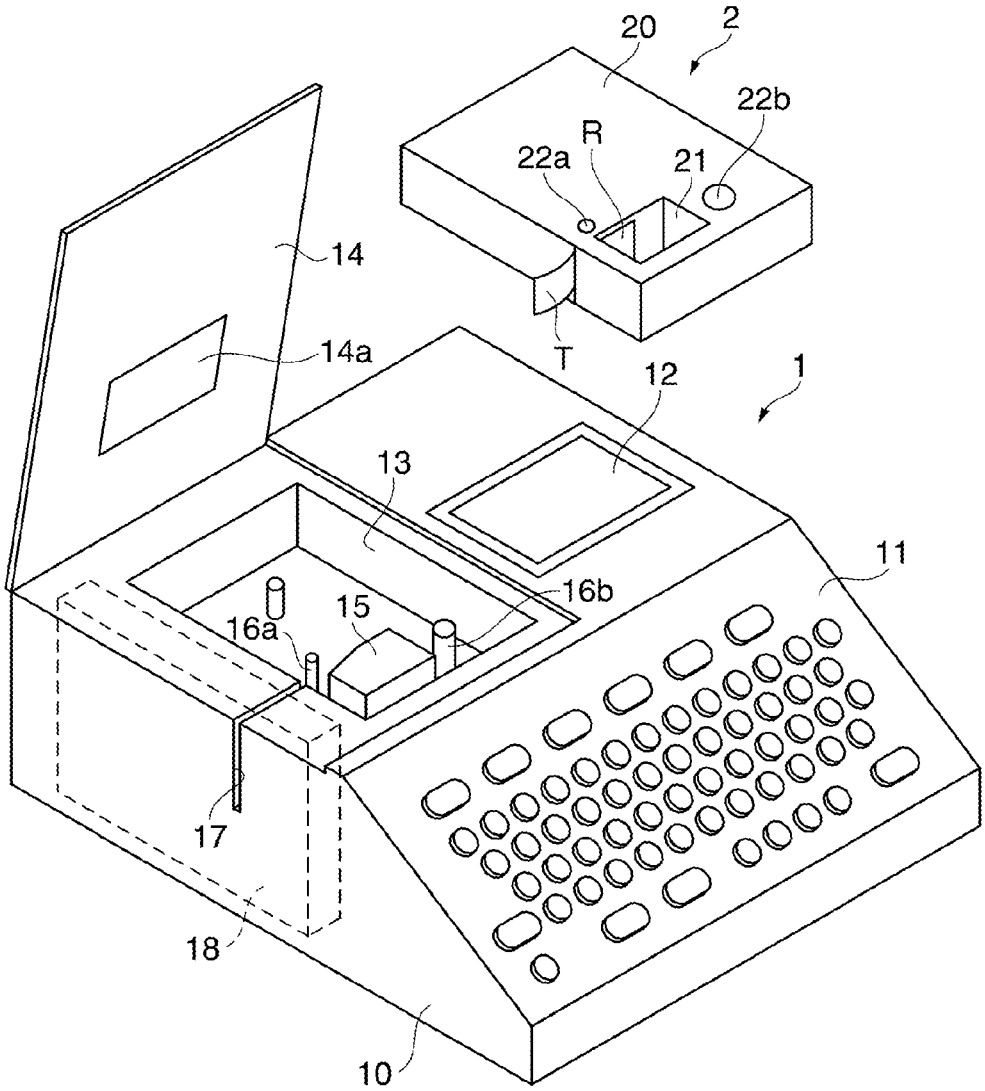
FIG. 2 is a perspective view of the tape printer.

FIGS. 1 and 2 are perspective views of a tape printer according to this embodiment.

As illustrated in FIGS. 1 and 2, a tape printer 1 has a main body accommodated in a housing 10, and a keyboard 11 provided on the upper front surface of the housing 10. The keyboard 11 is an input unit for receiving various types of input operations such as input of a character string from an user, and has a number of character keys through which a character string containing Japanese syllabary, Chinese characters, alphabets, numerals, symbols and the like can be inputted, and a plurality of control keys through which various operation requests can be issued to the tape printer 1. The control keys of the keyboard 11 include a power source key for switching between on and off of a power source, a conversion key for converting inputted Japanese syllabary into Chinese characters, a decision key for deciding an inputted character string and the like, a cursor key used for shifting cursor, a printing key for performing printing, and other keys.

A display unit 12 containing a liquid crystal display device and the like is provided on the upper rear surface of the housing 10. The display unit 12 forms an image by using a number of pixels disposed in matrix, and displays characters inputted through the keyboard 11, a menu image, a message image and others.

A concave 13 for receiving a tape cartridge 2 is further formed on the upper rear surface of the housing 10 next to the display unit 12. An open/close cover 14 is provided above the opening of the concave 13 in such a manner as to be openable and closable. The tape cartridge 2 can be attached to the concave 13 while the open/close cover 14 is opened. The open/close cover 14 has a check window 14*a* having light transmissivity such that whether the tape cartridge 2 has been attached to the concave 13 or not can be visually checked from the outside through the check window 14*a*. A thermal head 15 having a projecting shape and rotation shafts 16*a* and 16*b* of a feed mechanism 16 (see FIG. 3) are provided on the bottom surface of the concave 13. When the tape cartridge 2 is attached to the concave 13, the thermal head 15 engages with a hole-shaped head engaging portion 21 of the tape cartridge 2. Also, the rotation shafts 16*a* and 16*b* engage with hole-shaped driven portions 22*a* and 22*b*.

The tape cartridge 2 has a tape T and an ink ribbon R each of which is belt-shaped and accommodated inside a cartridge case 20. The tape T is a printing medium for the tape printer 1, and has an adhesive layer on the rear surface of a base material constituted by PET (polyethylene terephthalate), paper or the like. The adhesive layer is covered by released paper. The tape printer 1 can receive various types of the tape cartridge 2 containing various types of the tape T in width, material (base material), color or the like. Thus, an user of the tape printer 1 can freely select the tape cartridge 2 in accordance with the purpose of use or preference of the user. A plurality of holes (not shown) for recognizing the width of the accommodated tape T are formed on the rear surface of the tape cartridge 2 such that the tape printer 1 can recognize the tape width of the attached tape cartridge 2 by using a detection sensor 19 (see FIG. 3) including a micro-switch or the like and disposed on the bottom surface of the concave 13.

When the tape cartridge 2 is attached to the concave 13, the surface of the tape T faces the thermal head 15 via the ink ribbon R in the head engaging portion 21. The thermal head 15 has a number of heat generating elements (not shown) disposed in one line in a direction perpendicular to the longitudinal direction (feeding direction) of the tape T such that ink on the ink ribbon R can be transferred on the surface of the tape T by heat of the heat generating elements selectively allowed to generate heat (thermal transfer). As a result, dots are formed at positions corresponding to the positions of the heat generating elements having generated heat on the surface of the tape T. Then, the tape T and the ink ribbon R are shifted by rotations of the rotation shafts 16*a* and 16*b* such that the tape T can be discharged out of the cartridge case 20 and that the ink ribbon R can be wound inside the cartridge case 20. This thermal transfer is repeated while shifting the tape T and the ink ribbon R little by little to print an image constituted by plural dots (including characters) on the surface of the tape T.

A slit 17 connecting the outside of the housing 10 and the concave 13 is formed on the side surface of the housing 10. The tape T discharged from the cartridge case 20 after printing is shifted toward the outside of the housing 10 by a predetermined amount through the slit 17. A cutter unit 18 for cutting the tape T crossing the slit 17 is provided within the housing 10. The portion of the tape T after printing is cut by the cutter unit 18, and discharged from an opening of the slit 17 (tape outlet) as a tape piece (label).

Figure 3:
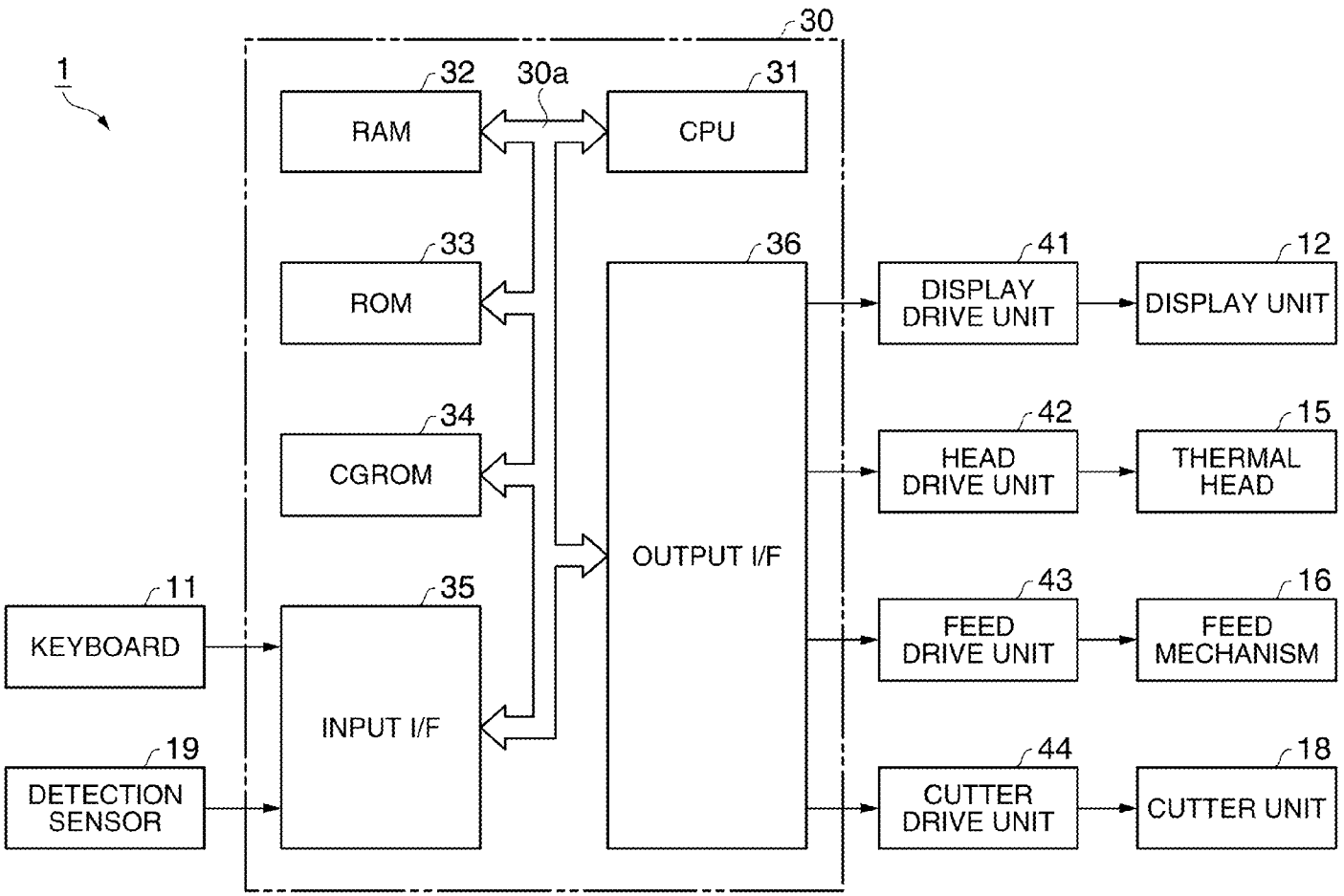
FIG. 3 is a block diagram showing a circuit structure of the tape printer.
Figure 4:
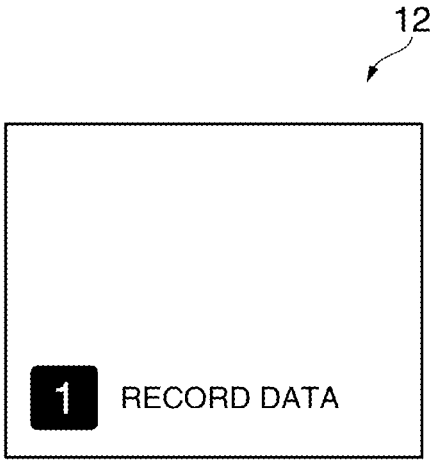
FIG. 4 is a plan view of a display unit.
Figure 5:
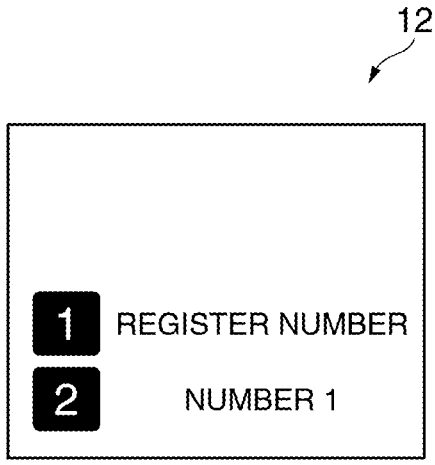
FIG. 5 is a plan view of the display unit.

FIG. 3 is a block diagram showing a circuit structure of the tape printer 1. FIGS. 4 and 5 are plan views showing the display unit 12.

As shown in FIG. 3, the tape printer 1 includes the keyboard 11, the display unit 12, the thermal head 15, the feed mechanism 16 having the rotation shafts 16*a* and 16*b* (see FIG. 2), the cutter unit 18, and the detection sensor 19 described above, and further a control unit 30 for supervising and controlling the operations of the tape printer 1, a display drive unit 41 for allowing the display unit 12 to display an image, a head drive unit 42 for allowing the thermal head 15 to generate heat, a feed drive unit 43 for actuating the feed mechanism 16, and a cutter drive unit 44 for actuating the cutter unit 18.

The control unit 30 functions as a computer, and includes a CPU (central processing unit) 31, RAM (random access memory) 32, a ROM (read only memory) 33, a CGROM (character generator ROM) 34, an input interface (I/F) 35, an output interface (I/F) 36, and the like connected with one another via a bus 30*a*.

The CPU 31 operates under a control program stored in the ROM 33, and controls various operations of the tape printer 1. The RAM 32 is a memory unit having a volatile memory device to temporarily store results of various processes performed by the CPU 31, character codes of characters inputted through the keyboard 11, image data of images displayed on the display unit 12, and others.

The ROM 33 and the CGROM 34 are memory units each of which has a non-volatile memory device such as mask ROM, flash memory and the like. The ROM 33 stores the control program discussed above, various types of data and the like.

The CGROM 34 stores font data of characters allowed to be printed by the tape printer 1. The font data is bit map type data used for printing characters by the thermal head 15 and for displaying characters on the display unit 12, and shows characters by using a number of dots corresponding to the heat generating elements of the thermal head 15 and pixels of the display unit 12. The CGROM 34 stores font data for plural fonts. The CPU 31 specifies font types, character sizes, and character codes to acquire appropriate font data from the CGROM 34, and creates image data for display and printing by using the acquired font data. The font data may be outline type font data easily matched with various character sizes.

The keyboard 11 and the detection sensor 19 are connected with the input interface 35. When the keyboard 11 is operated by the user, the keyboard 11 receives this operation and outputs key information corresponding to the operated key to the CPU 31 via the input interface 35. The detection sensor 19 outputs detection information corresponding to the tape width of the attached tape cartridge 2 to the CPU 31 via the input interface 35.

The display drive unit 41, the head drive unit 42, the feed drive unit 43, and the cutter drive unit 44 are connected with the output interface 36. The display drive unit 41, the head drive unit 42, the feed drive unit 43, and the cutter drive unit 44 actuate the display unit 12, the thermal head 15, the feed mechanism 16, and the cutter unit 18, respectively, under the control of the CPU 31.

When the power source key of the tape printer 1 having this structure is operated by the user, the tape printer 1 is brought into operation start condition which allows characters to be inputted through the character keys and various requests to be issued through the control keys. When characters are inputted by the user through the character keys, the keyboard 11 receives this input and outputs the key information to the control unit 30. The control unit 30 specifies the character codes of the inputted characters based on the key information inputted through the keyboard 11, and stores the character codes in the RAM 32. Then, the control unit 30 acquires the font data corresponding to the character codes from the CGROM 34, and creates image data for display by using the acquired font data. The control unit 30 supplies this image data to the display drive unit 41 to display the inputted characters on the display unit 12. After character input in this manner is repeated by the user a plurality of times, a character code string containing a plurality of character codes (text data) is stored in the RAM 32. As a result, a character string constituted by a plurality of characters is displayed on the display unit 12 (for example, see FIGS. 4 and 5).

In response to operation of the printing key by the user after input of characters (a character string), the tape printer 1 executes printing. When the inputted character string contains a numeral expressing a number (a numeral string), the tape printer 1 in this embodiment is allowed to perform "sequential number printing" which repeats printing a plurality of times while sequentially changing the numeral according to a predetermined rule.

Figure 6:
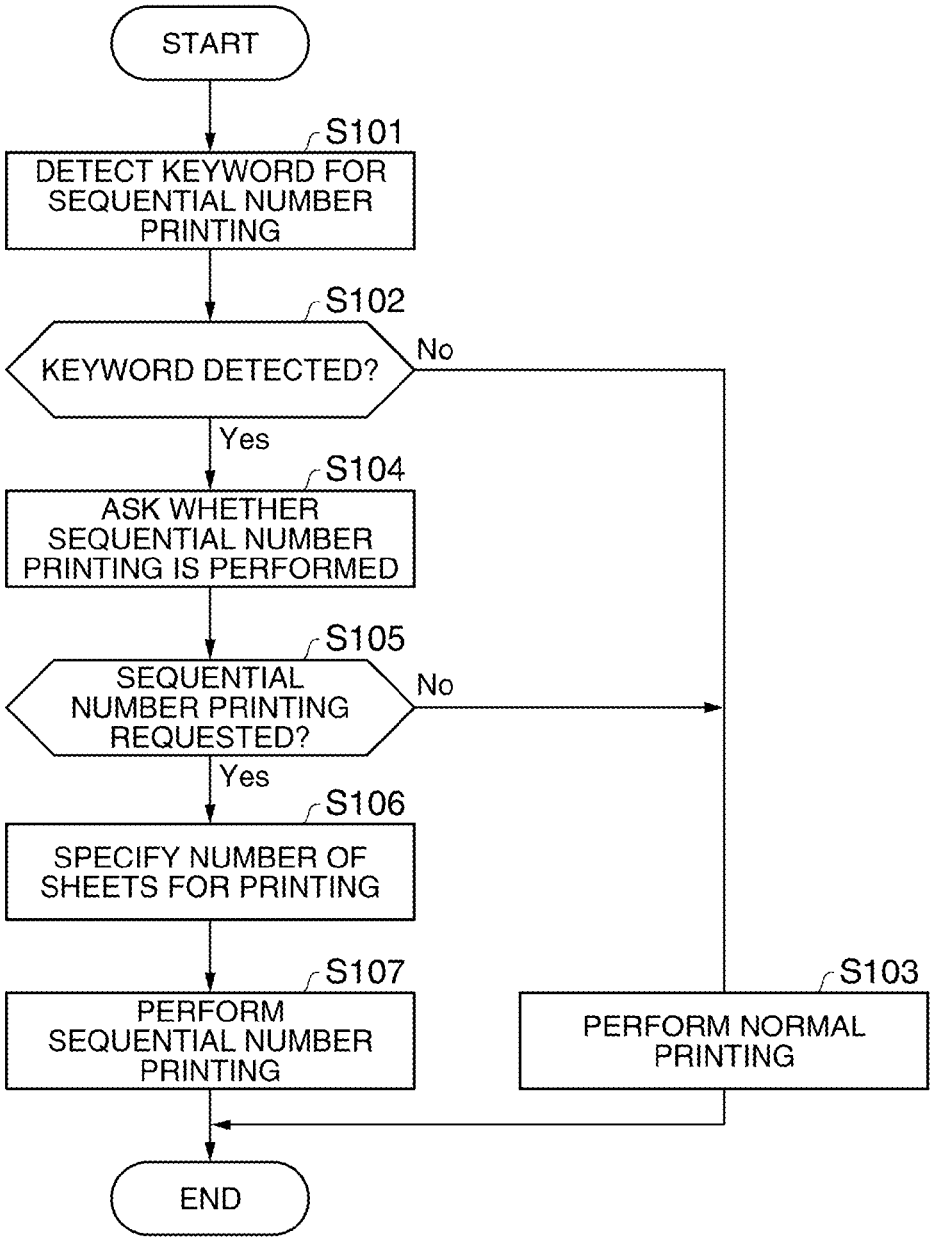
FIG. 6 is a flowchart showing a printing process.
Figure 7:
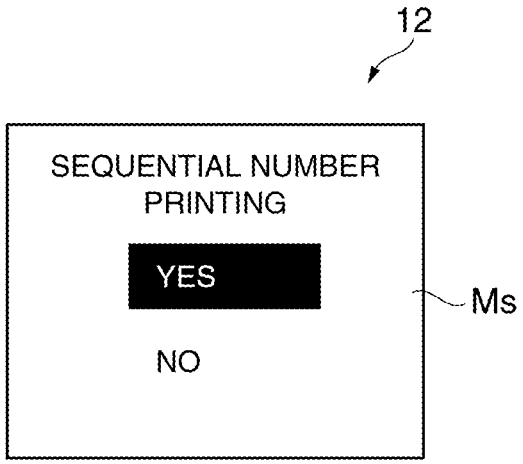
FIG. 7 is a plan view of the display unit.
Figure 8:
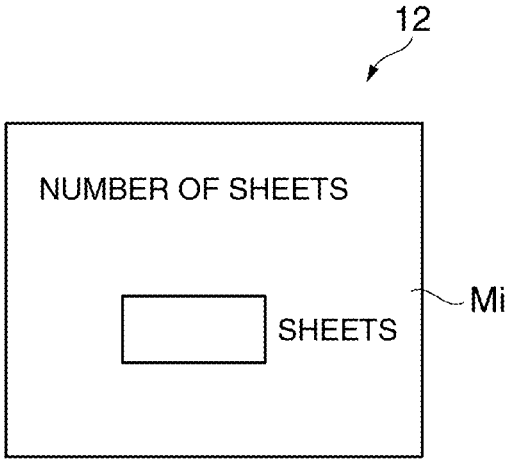
FIG. 8 is a plan view of the display unit.
Figure 9:
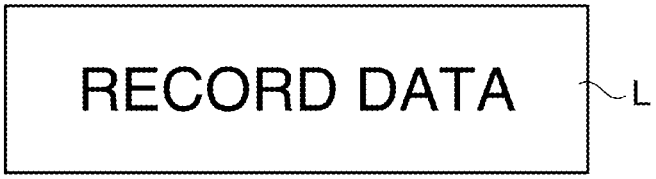
FIG. 9 is a plan view of a label after printing.
Figure 10:
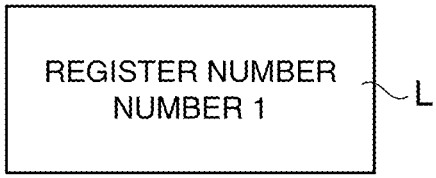
FIG. 10 is a plan view of a label after printing.
Figure 11:
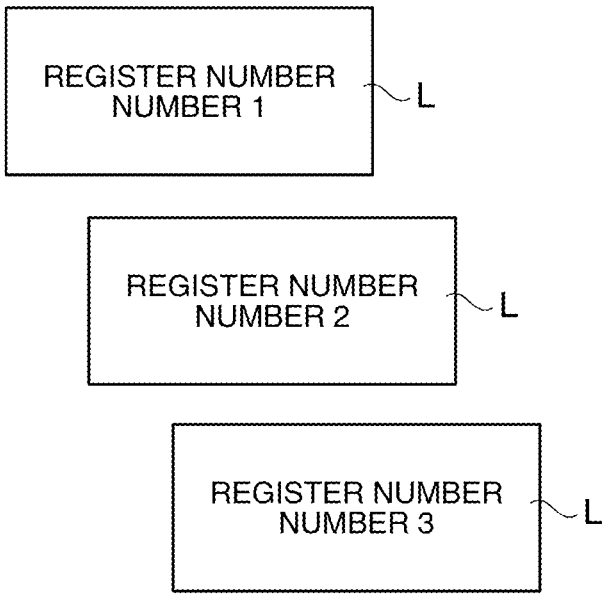
FIG. 11 is a plan view of labels after printing.

FIG. 6 is a flowchart showing a printing process. FIGS. 7 to 11 are views explaining the printing process. More specifically, FIGS. 7 and 8 are plan views of the display unit 12, and FIGS. 9 to 11 are plan views of labels after printing. When the user operates the printing key after finishing input of characters, the tape printer 1 initiates operation according to the flowchart shown in FIG. 6.

As shown in FIG. 6, the control unit 30 detects a keyword for sequential number printing from an inputted character string based on the character code string stored in the RAM 32 in step S101. The keyword for sequential number printing refers to a character string suggesting execution of sequential number printing. In this embodiment, a character string as a combination of characters "No." and a numeral (such as "No. 1"), and a character string as a combination of characters "Number" and a numeral (such as "Number 1") are defined as the keywords for sequential number printing.

In step S102, the control unit 30 determines whether the keyword for sequential number printing has been detected from the inputted character string. When no keyword has been found in the inputted character string as in the example shown in FIG. 4, the flow goes to step S103. When the keyword ("Number 1") for sequential number printing has been found in the inputted character string as in the example shown in FIG. 5, the flow goes to step S104.

When the flow goes to step S103 based on the determination that no keyword for sequential number printing has been detected, the control unit 30 performs ordinary printing (normal printing) which does not carry out sequential number printing, and ends the flow. More specifically, the control unit 30 acquires font data corresponding to the inputted characters from the CGROM 34 and creates image data for printing. Then, the control unit 30 allows the head drive unit 42 and the feed drive unit 43 to actuate the thermal head 15 and the feed mechanism 16, and prints an image corresponding to the image data on the tape T. Subsequently, the control unit 30 allows the cutter drive unit 44 to actuate the cutter unit 18. As a result, the tape T is cut into a label L on which the inputted character string has been printed as a final shape (for example, see FIG. 9).

When the flow goes to step S104 based on the determination that the keyword for sequential number printing has been detected, the control unit 30 allows the display drive unit 41 to display an operation selection menu Ms (see FIG. 7) which asks the user YES or NO about execution of sequential number printing (whether sequential number printing is performed or not) on the display unit 12. The operation selection menu Ms contains two items of "YES" expressing that sequential number printing is performed, and "NO" expressing that sequential number printing is not performed at positions disposed side by side in the vertical direction below a title of "SEQUENTIAL NUMBER PRINTING". One of the two items ("YES" in the example shown in FIG. 7) is shown as a negative display having reversed light and shade, indicating that this item has been selected. The user can select the other item by operating the cursor key corresponding to the up-down direction. After selecting the desired item, the user operates the decision key to give an answer about execution of sequential number printing. That is, the user responds to the inquiry by operating the cursor key and the decision key on the keyboard 11, and the control unit 30 receives this response.

In step S105, the control unit 30 determines whether "YES" has been selected on the operation selection menu Ms, that is, whether execution of sequential number printing has been requested by the user. When it is determined that "YES" has been selected, that is, when the control unit 30 receives a response requesting execution of sequential number printing, the flow goes to step S106. When it is determined that "NO" has been selected, that is, when the control unit 30 receives a response not requesting execution of sequential number printing, the flow goes to step S103. In this case, the control unit 30 performs normal printing and ends the flow. As a result, the label L on which the inputted character string has been printed is completed (for example, see FIG. 10).

When the flow goes to step S106 based on the request for execution of sequential number printing by the user, the control unit 30 allows the display drive unit 41 to display a sheet number input screen Mi (see FIG. 8) as a screen asking the user how many sheets the user desires to produce by sequential number printing on the display unit 12. The sheet number input screen Mi contains an input space to which the desired number of sheets is inputted below a title of "NUMBER OF SHEETS". The user inputs the number of sheets for printing by operating the character key corresponding to the number, and then operates the decision key to specify the number of sheets the user desires to produce by sequential number printing.

When the flow goes to step S107 after the step of specifying the number of sheets for printing by the user, the control unit 30 performs sequential number printing for the specified number of sheets and ends the flow. More specifically, the control unit 30 performs normal printing for the inputted character string, and cuts the tape T. Then, the control unit 30 increments the numeral contained in the keyword for sequential number printing by one, and creates new image data for printing. Then, the control unit 30 again executes printing and cutting based on this image data, and repeats these processes until printing for the specified number of sheets is completed. That is, the control unit 30 performs printing a plurality of times by allowing the head drive unit 42, the feed drive unit 43, and the cutter drive unit 44 to actuate the thermal head 15, the feed mechanism 16, and the cutter unit 18, respectively, while sequentially changing the numeral. When three is specified as the number of sheets for printing, for example, three sheets of the label L on which numerals different for each have been printed are produced as shown in FIG. 11.

Accordingly, the tape printer 1 in this embodiment provides the following advantages.

(1) According to this embodiment, the tape printer 1 performs sequential number printing without requiring particular operation for invoking the sequential number printing function, that is, without particular operation for requesting execution of sequential number printing when the character string inputted through the keyboard 11 contains the keyword for sequential number printing which includes a numeral or the like. Thus, such an user unfamiliar with the operation of the tape printer 1 can easily carry out sequential number printing.

(2) According to this embodiment, the tape printer 1 performs sequential number printing when the character string inputted through the keyboard 11 contains the keyword for sequential number printing, that is, a numeral and characters indicating that the numeral expresses a number ("No." or "Number"). Thus, sequential number printing can be further securely performed (unnecessary sequential number printing is not performed).

(3) According to this embodiment, the tape printer 1 asks the user YES or NO about execution of sequential number printing when the character string inputted through the keyboard 11 contains the keyword for sequential number printing. In this case, sequential number printing is only carried out when the user gives an answer showing that sequential number printing is performed, that is, when "YES" is selected on the operation selection menu Ms. Thus, unnecessary sequential number printing is not executed.

(4) According to this embodiment, the tape printer 1 performs printing only for the specified number of sheets for sequential number printing. Thus, the necessity for repeating operation requesting printing for the number of times corresponding to the desired number of sheets is eliminated, and thus the usability of the tape printer 1 is enhanced.

According to this embodiment, the keyboard 11 corresponds to an input unit, and the head drive unit 42, the feed drive unit 43, the thermal head 15, and the feed mechanism 16 used for performing printing (normal printing or sequential number printing) on the tape T under the control of the control unit 30 (CPU 31) correspond to a printing unit. A numeral contained in the character string inputted through the keyboard 11 corresponds to a first character string expressing a number. Characters "No." and "Number" correspond to a second character string indicating that the first character string expresses a number. The control unit 30 which executes step S101 (see FIG. 6) to detect the keyword for sequential number printing corresponds to a detecting unit.

MODIFIED EXAMPLE

This embodiment may be modified in the following manners.

According to this embodiment, the number of sheets for printing is specified by the user. However, the numeral contained in the character string may be varied by one every time the printing key is operated without requiring the user to specify the number of sheets for printing. In this case, the user needs to operate the printing key for the number of times corresponding to the desired number of sheets for printing.

According to this embodiment, the inputted numeral is incremented by one in sequential number printing. However, the numeral may be decremented by one. Moreover, whether the numeral is incremented or decremented may be determined by the user.

According to this embodiment, the user specifies the number of sheets for printing in performing sequential number printing. However, the user may specify the final numeral instead of the number of sheets for printing. In this case, the tape printer 1 repeats printing while changing the numeral inputted first, that is, the numeral detected as the keyword for sequential number printing by one, and finishes sequential number printing when the numeral reaches the specified final numeral. According to this method, printing can be repeated for the desired number of times by specifying the final numeral. Thus, the necessity for repeating the printing operation is eliminated, and the usability of the tape printer 1 is enhanced. Moreover, since the numeral is incremented when the specified final numeral is larger than the numeral inputted first and is decremented when the specified final numeral is smaller than the numeral inputted first, the necessity for requiring the user to determine whether the numeral is incremented or decremented is eliminated. The final numeral specified by the user corresponds to a third character string.

The numeral contained in the keyword for sequential number printing in this embodiment is not limited to an Arabic numeral but may be a Roman numeral or a Chinese numeral. The numeral is not limited to one digit but may be several digits.

According to this embodiment, the keyword for sequential number printing is defined as a combination of the first character string constituted by a numeral and the second character string constituted by characters "No." or "Number". However, the keyword for sequential number printing is not limited to this combination. For example, the first character string may be an alphabet letter or letters instead of a numeral, and the second character string may be characters such as "group", "row", and "#". In this case, sequential number printing which prints "A group", "B group", and "C group" can be performed. The second character string is not essential to the keyword for sequential number printing, and only the first character string (such as a numeral) may be used as the keyword for sequential number printing.

According to this embodiment, the tape T is cut by the cutter unit 18 every time one operation of printing is finished in sequential number printing. However, plural character strings which contain sequentially variable numerals may be printed on the tape T at a time, and the tape T after printing may be manually cut into individual pieces by the user or by other methods as necessary.

According to this embodiment, the numeral as the first character string is incremented by one in sequential number printing. However, the amount of change of the first character string is not limited to one but maybe two or larger. For example, when the amount of change is two, the first character string changes in such a manner as 1, 3, 5, 7, or A, C, E, G.

According to this embodiment, ON and OFF of sequential number printing may be switched by environmental setting or the like. In this case, the operation starts according to the flowchart shown in FIG. 6 only when the sequential number printing function is turned on, and normal printing always starts when the sequential number printing function is turned off regardless of the condition whether the keyword for sequential number printing is contained in the character string.

According to this embodiment, thermal transfer system by using the thermal head 15 is employed as printing system for printing characters on the tape T. However, other printing systems such as ink jet system ejecting ink drops may be adopted.

What is claimed is:

1. A tape printer which prints an inputted character string on a tape, comprising:

an input unit that receives input of the character string to be printed on the tape;

a detecting unit that detects, in the character string received by the input unit, a keyword which contains a first character string expressing a number;

a control unit that sets a sequential number printing which repeats printing while sequentially changing the first character string when the detection unit detects the keyword; and a printing unit that performs the sequential number printing based on the setting of the sequential number printing by the control unit, wherein the control unit prompts a user to select whether sequential number printing is to be performed when the detecting unit detects the keyword and receives a selection from the user in response to the prompt, and the control unit sets the sequential number printing when the control unit receives a selection from the user indicating that the sequential number printing is to be performed.

2. The tape printer according to claim 1, wherein the control unit prompts a user to specify the number of sheets for the sequential number printing when the detecting unit detects the keyword, and the control unit sets the sequential number printing to repeat printing for a number of times corresponding to the specified number of sheets for the sequential number printing while sequentially changing the first character string.

3. The tape printer according to claim 1, wherein the keyword detected by the detecting unit includes the first character string and a second character string expressing at least one alphabetic character, the second character string indicating that the first character string expresses a number.

4. The tape printer according to claim 3, wherein the second character string is fixed so as to not to be changed by the sequential number printing.

5. The tape printer according to claim 1, wherein the control unit prompts a user to specify a third character string expressing a number when the detecting unit detects the keyword, and the control unit sets the sequential number printing to repeat printing while sequentially changing the first character string until the first character string agrees with the inputted third character string.

6. The tape printer according to claim 5, wherein the control unit sets the sequential number printing in such a way as to increase the first character string when the third character string is larger than the first character string, and in such a way as to decrease the first character string when the third character string is smaller than the first character string.

7. A tape printer control method which prints an inputted character string on a tape, comprising:

receiving input of the character string to be printed on the tape;

detecting a keyword in the received character string, wherein the keyword contains a first character string expressing a number;

prompting, in response to the detecting of the keyword, a user to select whether sequential number printing is to be performed or not;

receiving, from the user in response to the prompting, a selection indicating that the sequential number printing is to be performed;

setting the sequential number printing which repeats printing while sequentially changing the first character string; and performing the sequential number printing based on the setting of the sequential number printing.

* * * * *